US006450093B1

(12) United States Patent
Jentzsch et al.

(10) Patent No.: US 6,450,093 B1
(45) Date of Patent: Sep. 17, 2002

(54) METHOD AND APPARATUS FOR INK SUPPLY TO INK TRAYS OF PRINTING PRESSES

(75) Inventors: Arndt Jentzsch, Coswig; Uwe Becker, Radebeul; Berndt Patzclt, Chemnitz, all of (DE)

(73) Assignee: Koenig & Bauer AG, Würzburg (DE)

( * ) Notice: Subject to any disclaimer, the term of this patent is extended or adjusted under 35 U.S.C. 154(b) by 0 days.

(21) Appl. No.: 09/595,206

(22) Filed: Jun. 16, 2000

(30) Foreign Application Priority Data

Jun. 19, 1999 (DE) ..... 199 28 197

(51) Int. Cl.[7] ..... B41F 31/02
(52) U.S. Cl. ..... 101/365
(58) Field of Search ..... 101/207, 208, 101/210, 315, 321, 326, 331, 350.1, 351.8, 364–367

(56) References Cited

U.S. PATENT DOCUMENTS 3,199,451 A * 8/1965 Nitchie ..... 101/366
3,848,529 A * 11/1974 Gegenheimer et al. ..... 101/350
4,787,313 A * 11/1988 Osborn et al. ..... 101/366
5,265,535 A * 11/1993 Isowa et al. ..... 101/350
5,724,890 A * 3/1998 Deschner et al. ..... 101/366
5,967,049 A * 10/1999 Seymour et al. ..... 101/484
5,967,050 A * 10/1999 Seymour ..... 101/484
5,992,318 A * 11/1999 DiBello et al. ..... 101/181
6,019,041 A * 2/2000 Leonhardt et al. ..... 101/366

* cited by examiner

*Primary Examiner*—Eugene Eickholt
(74) *Attorney, Agent, or Firm*—Goodwin Procter LLP

(57) ABSTRACT

A method for supplying printing ink to an ink tray of a printing press having a plurality of ink zones throughout the width of the printing to be done, an ink tray and an ink ball extending over the width and having a longitudinal axis along the printing to be done and being substantially coextensive with the ink tray, an ink supplying means at an ink supplying location, and an ink spatula for distribution of ink within the ink tray, the method comprising determining the ink requirement data for the various ink zones, inputting the ink requirement data into a computer for producing a plurality of control signals for regulating the supplied ink in supply cycles to the ink zones, supplying ink to each ink zone at the location of each ink zone, shifting the supplied ink by the ink spatula to a zone in need of ink, with priority being given during the supply cycle to the ink requiring ink zone that is most remote from the ink supplying location, the amount of ink being supplied during the supply cycle being sufficient to prevent the amount of ink from falling to below a predetermined minimum ink level in each ink zone.

14 Claims, 3 Drawing Sheets

METHOD AND APPARATUS FOR INK SUPPLY TO INK TRAYS OF PRINTING PRESSES

The invention relates to a method for supplying ink to an ink tray of a printing press, wherein the ink consumption of the ink zones of the printing area is determined, the so determined data is sent to a computer, processed in the computer and control signals for the zonal ink supply are provided to the single ink zones according to the local ink consumption. The invention also relates to an apparatus for supplying ink to an ink tray of a printing press, wherein a stationary ink supply device is allocated to the ink tray and is controlled by a computer, and an ink ball extending over the entire width of the printing area and allocated to the ink tray establishing a dosing gap with an ink blade, which is separated into multiple ink zones.

BACKGROUND

An apparatus to establish a constant ink level in ink trays of printing presses is known from German patent No. 2,324,462. The constant ink level is sought to keep at a low level the printing ink volume in the ink tray. For this purpose an ink agitator is used, traversing along the ink ball is used. The movement creates a wave which is sensed by a sensor traveling above the ink agitator as a gauge for the ink level. If the ink level is exceeding a preset level the ink supply is stopped.

This solution was stated to guarantee a constant low ink level in the ink tray. It is, however, not possible to supply the ink to particular ink zones according to the ink consumption requirements.

This problem is stated to be solved by German patent No. 19,512,727 by providing an ink cartridge that is movable on a slide. A traveling sensor is allocated in the direction of motion before the ink cartridge to detect the zonal ink level in the various ink zones. The sensor sends a control signal if the ink level is too low. This causes the release of an appropriate amount of ink from the ink cartridge to the ink zone that is in need for more ink.

The latter structure has the disadvantage that the supplied fresh inkplaced on top of the already existing ink in supply the ink zones and therefore fresh and old ink become mixed, causing printing with ink of varying rheological properties.

SUMMARY DESCRIPTION OF THE INVENTION

It is an object of the present invention to provide a method and apparatus for zonal ink dosage according to the ink requirements, whereby the ink already in the ink tray and supplied fresh ink are intensively mixed with each other.

It is also an object of the present invention to provide a method and apparatus for zonal ink dosage according to ink requirements with an intensive mixing of ink already in the ink tray and fresh supplied ink.

These objects are solved according to the present invention by a zonal ink supply to the ink zones in supply cycles, whereby the required amount of ink for the ink zones is supplied by a fixed ink supply device and shifted by an ink spatula from this supply location to the ink needing ink zones.

It is an advantage of the solution according to the present invention that the ink has the same rheological properties over the entire width of the ink tray. An ink profile according to demand is kept over the entire width of the ink tray during the whole printing process. The ink tray always carries a minimum amount of ink, so that only small amount of ink remains in the ink tray at the end of a printing job.

BRIEF DESCRIPTION OF THE DRAWING

The invention is described below in greater detail by way of embodiments of the invention, by reference being had to the drawing, wherein.

DETAILED DESCRIPTION

Figure 1:
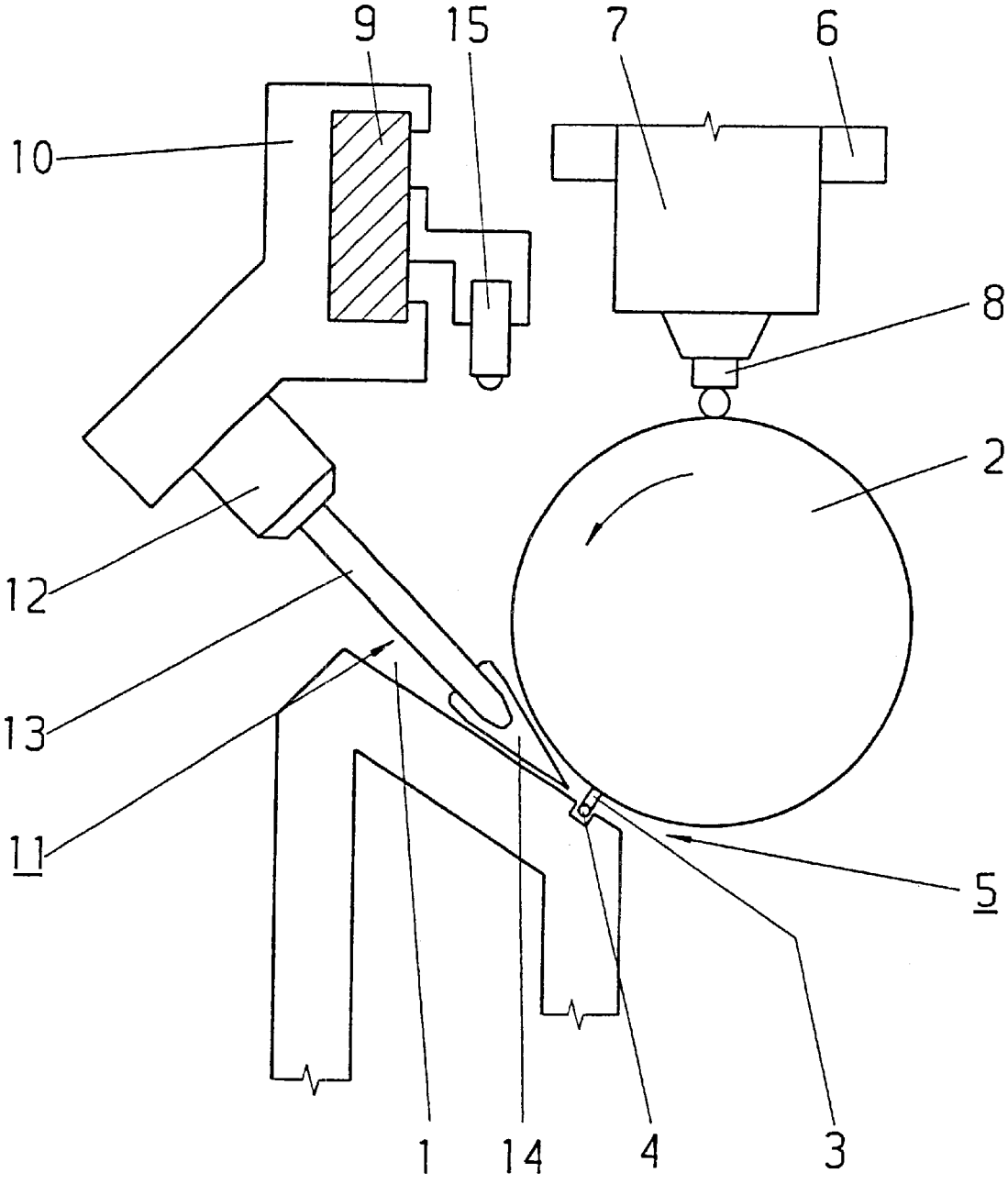
FIG. 1 is a schematic cross-sectional view of the device of the invention.
Figure 2:
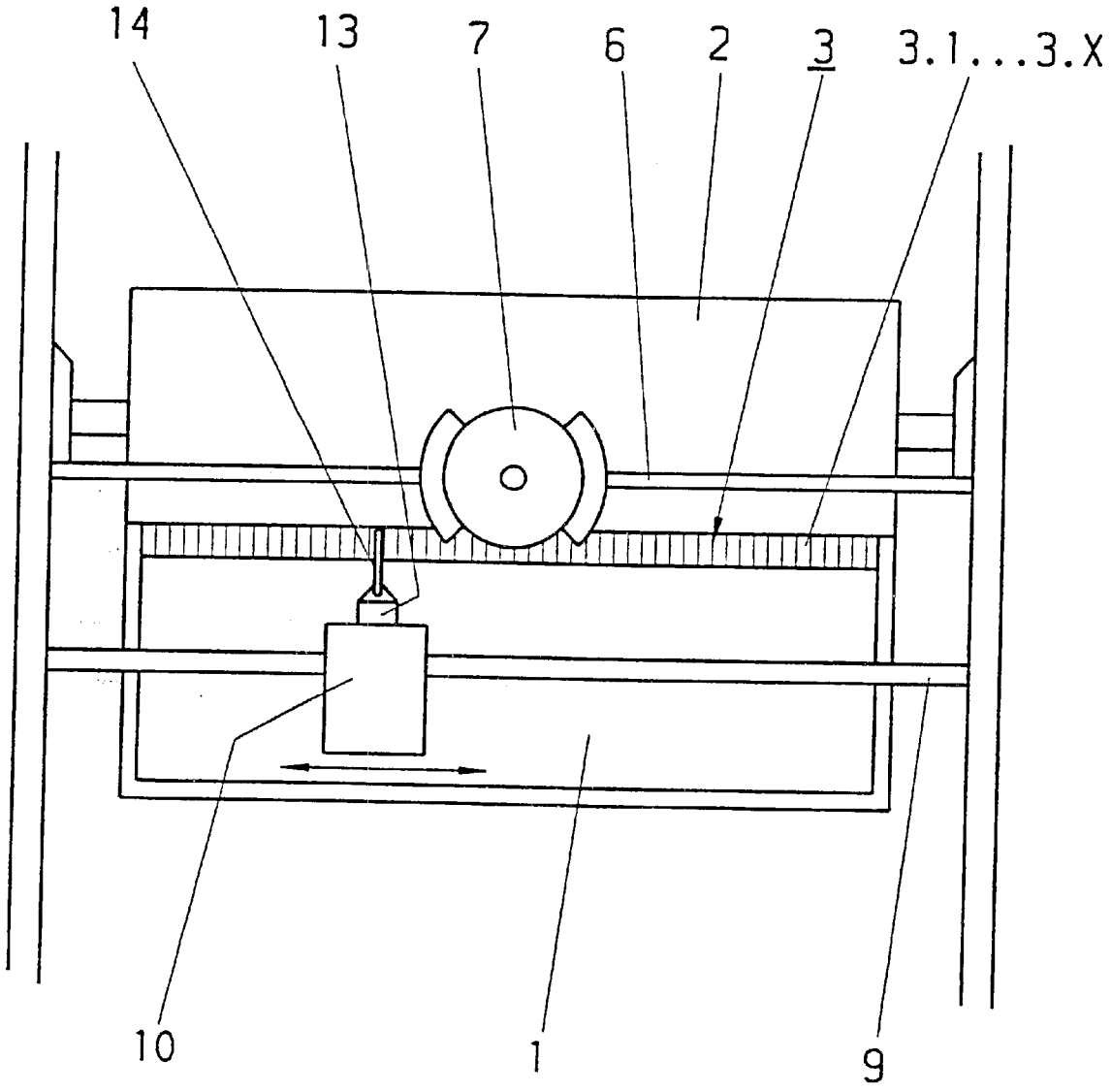
FIG. 2 is a top view of the device of FIG. 1.

FIGS. 1 and 2 show the device of the present invention, having an ink tray 1 with an adjoined ink ball 2. The ink ball 2 extends over the entire width of the ink tray 1. The ink tray 1 carries an ink blade 3 on the side toward the ink ball 2. The ink blade 3 is separated in multiple sections 3.1 . . . 3.x, the so-called ink zones (see also FIG. 2). Ink dosing elements 4 are allocated to the various ink zones. These elements 4 bring the appropriate section of the ink blade 3 to a defined distance from the ink ball 2 depending on the ink requirements of the corresponding ink zones, so that a dosing gap 5 is established between the ink blade 3 and the ink ball 2 over its entire length.

A mounting 6 for an ink supply device and respectively an ink reservoir having an ink cartridge 7 is located above the ink ball 2. The preferred location for the ink supply is in the center of the ink ball, but a location at outer ink zones is also possible. The ink cartridge 7 has an outlet valve 8 controlled by a computer (not shown). A constant pressure in the ink cartridge 7 is realized by pneumatic or other suitable means (not shown).

A crossbar 9 extending over the entire width of the ink tray I is located at the ink tray 1. The crossbar 9 carries a traveling slide 10 with an ink spatula 11. The ink spatula 11 has a receptacle 12, a mounting 13 and a spatula blade 14. The spatula blade 14 is set during ink transportation at such a position, that a minimum gap is established between spatula blade 14 and the ink ball 2, as well as between spatula blade 14 and the ink tray 1. The mounting 13 can be rotated in the receptacle 12. A sensor 15 for detecting the ink level in the ink tray 1 is affixed from the crossbar 9. The traveling ink supply device 7 and ink spatula 11 are connected to a computer.

Figure 3:
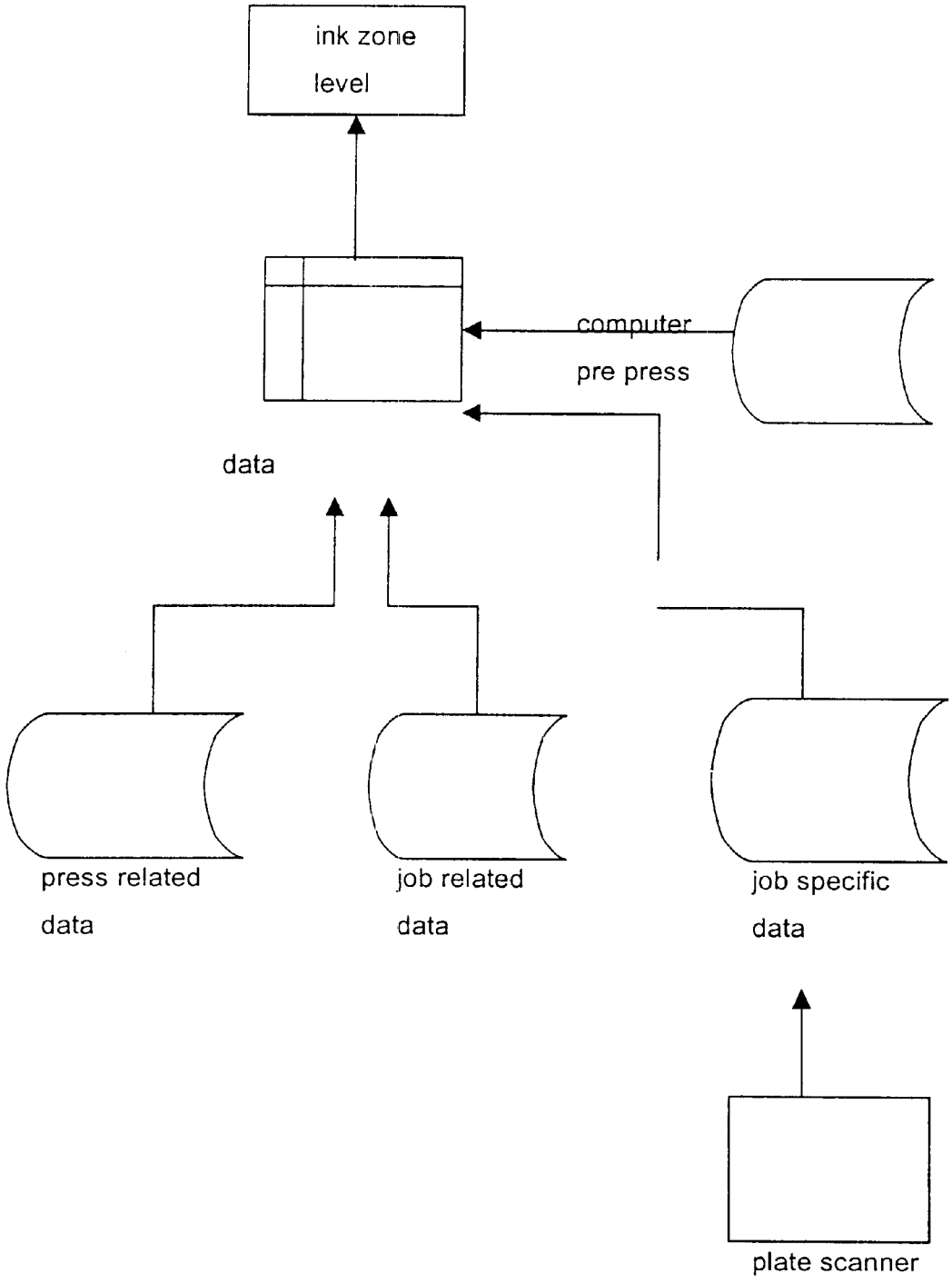
FIG. 3 is a flow chart showing the computer input scheme.

In operation of the above-described device according to the invention the ink consumption of the individual ink zones is determined by a computer receiving data about the running printing job, as shown in the flow chart of FIG. 3. This data can also be produced either by a plate scanner or by other known pre-press data for the printing job. Furthermore all press-dependent variable data, e.g. the number of evolutions of the ink ball 2, are permanently determined and fed to the computer; and the press-dependent invariable data is stored in the memory of the computer. All this data is processed in the computer and control signals are generated thereby according to the local ink requirements to be released for supplying the individual ink zones.

Zonal ink dosing is carried out in supply cycles according to the present invention. A supply cycle has job related and computer-determined number of dosing operations for the ink supply to the ink zones, whereby normally each ink zone receives a different amount of ink. Some ink zones will not receive ink in every dosing cycle, certain ink zones will get ink supply e.g. only in every third dosing cycle. The ink supplied within a dosing cycle does not fall below a definite fixed minimum amount for each ink zone. This prevents the ink tray I from being emptied.

A sensor 15 controls the ink level in the ink tray 2 and ensures that the deviations of the ink level in the ink tray 1 are within pre-defined tolerances.

Ink dosing takes place in that the required amount of ink for the supply of the ink zones is provided by a fixedly mounted ink cartridge 7. Dosing is made advantageously to the ink ball 2 suitably in its center. The ink spatula 11 shifts the supplied ink in the direction of the outer ink zones of the ink tray 1 to the ink needing ink zones. Therefore the ink must be supplied in front of the moving direction of the ink spatula 11. For this purpose the computer determines which ink zone must be supplied with ink and where this ink zone is located in relation to the starting position of the ink spatula 11.

In another embodiment ink is supplied at the first or last ink zone of the ink tray. In this case the supplied ink is shifted by the ink spatula 11 in the direction of the other opposite ink zones. For this purpose the supply location must be outside of the last outer ink zone but within an extension of the ink ball 2.

The ink supply to the ink zones within the supply cycle is made in a fixed mode depending on the distance of the ink zone to be supplied from the supply location. The ink needing ink zone at the greatest distance will be supplied first. This means that if the supply location is in the middle of the ink ball 2 the outer ink zones will be supplied first in a supply cycle and if the supply location is at the outer ink zones the opposite outer ink zones will have supply priority.

Two variants can be used for ink dosing per ink zone. First, the required ink for an ink zone is supplied in one step. The ink amount varies and the outlet valve 8 must be time controlled under the condition, that the pressure in the ink cartridge is constant during the ink dosing. Second, the outlet valve 8 opens periodically, so that a defined amount of ink is provided. This process can be repeated during the supply cycle until the required amount of ink at the ink needing ink zone is provided. The ink spatula 11 shifts each of these discrete amounts to the ink needing ink zone or stays in its original position until the total required amount of ink is supplied and moves only then.

The ink spatula 11 returns to the supply location after the ink is shifted to a proper ink zone. Therefore the spatula blade 14 is rotated from its operating position. The spatula blade 14 of the ink spatula 11 is disposed in a rectangular direction to the ink transport direction during ink shifting and in transport direction during its return movement not to destroy establishing of the ink profile with this movement. The speed during the return movement is a multiple of the speed for shifting the ink.

In another embodiment of the method the ink spatula 11 rotates during shifting of the ink. The shifting movement is combined with ink agitation

What is claimed is:

1. A method for supplying printing ink to an ink tray of a printing press having a plurality of ink zones throughout the width of the printing to be done, an ink tray and an ink ball extending over the width and having a longitudinal axis along the printing to be done and being substantially coextensive with said ink tray, an ink supplying means at an ink supplying location, and an ink spatula for distribution of ink within the ink tray, the method comprising determining the ink requirement data for the various ink zones, inputting said ink requirement data into a computer for producing a purality of control signals for regulating the supplied ink in supply cycles to said ink zones, supplying ink to each ink zone at the location of each ink zone, shifting the supplied ink by the ink spatula to a zone in need of ink, with priority being given during said supply cycle to the ink requiring ink zone that is most remote from the ink supplying location, the amount of ink being supplied during said supply cycle being sufficient to prevent the amount of ink from falling to below a predetermined minimum ink level in each ink zone.

2. The method of claim 1, wherein said determining of the ink requirement data of said ink zones is made from press related, and/or printing job related specific data that are inputted into the computer.

3. The method of claim 2, wherein said determining is made from job specific data by a plate scanner.

4. The method of claim 2, wherein said determining is made from printing job-related pre-press data.

5. The method of claim 2, wherein said determining is made from sensed press-related data.

6. The method of claim 1, wherein said ink supplying location is at the ink ball.

7. The method of claim 6, wherein said ink supplying location is substantially at the center of said longitudinal axis of said ink ball.

8. The method of claim 1, wherein said ink supplying location is substantially at the center of said ink tray, and ink spatula shifts ink from said center towards the peripheries of said ink tray.

9. The method of claim 1, wherein said ink supplying location is at one periphery of said ink tray, and the spatula shifts ink from said periphery toward the other periphery.

10. The method of claim 1, wherein said ink spatula has a direction of movement, and the ink is shifted by said spatula before said spatula in its direction of movement.

11. The method of claim 1, wherein said supplying of ink to an ink requiring ink zone is carried out during said supply cycle in a single step.

12. The method of claim 1, wherein said supplying of ink to an ink requiring ink zone is carried out in said supply cycle in a plurality of repeated steps until the amount of ink required by said ink zones is furnished.

13. The method of claim 1, wherein said ink spatula is returned after the supply cycle to the ink supplying location while being rotated.

14. The method of claim 1, wherein the speed of returning said ink spatula is a multiple of the speed of shifting the ink to ink requiring ink zones.

* * * * *